United States Patent [19]

Moeller

[11] 4,376,588

[45] Mar. 15, 1983

[54] BI-DIRECTIONAL SERIAL PRINTER WITH LOOK-AHEAD

[75] Inventor: Dennis L. Moeller, Del Ray Beach, Fla.

[73] Assignee: International Business Machines Corporation, Armonk, N.Y.

[21] Appl. No.: 278,946

[22] Filed: Jun. 30, 1981

[51] Int. Cl.[3] ..... B41J 19/30

[52] U.S. Cl. ..... 400/322; 400/320

[58] Field of Search ..... 400/320, 322, 323, 328, 400/64; 318/282; 172/3 R, 30

[56] References Cited

U.S. PATENT DOCUMENTS

| | | | |
|---|---|---|---|
| 3,764,994 | 10/1973 | Brooks et al. | 340/172.5 |
| 3,970,183 | 7/1976 | Robinson et al. | 197/1 R |
| 4,114,750 | 9/1978 | Baeck et al. | 400/279 |
| 4,179,223 | 12/1979 | Kwan et al. | 400/320 |
| 4,180,335 | 12/1979 | Yamada | 400/322 X |
| 4,311,399 | 1/1982 | Wegryn et al. | 400/320 X |

*Primary Examiner*—Edward M. Coven

*Attorney, Agent, or Firm*—Walter J. Madden, Jr.

[57] ABSTRACT

A bi-directional serial printer has a look-ahead feature which determines the distance between the margin of the line being printed and the margin, in the direction of the print head travel, of the next line to be printed. If this distance is less than a predetermined number, print head motion continues after printing the last character on the present line until the print head reaches the margin position for the next line.

5 Claims, 3 Drawing Figures

BI-DIRECTIONAL SERIAL PRINTER WITH LOOK-AHEAD

BACKGROUND OF THE INVENTION

1. Field of the Invention

The invention relates to serial printers and, more particularly, to controls for such printers.

Serial printers are printers of the type having either a lesser number of printing elements than is necessary to print across an entire line or having a single print element. In the operation of a serial printer, the print element moves over a certain distance along a line and is actuated for effecting printing at a plurality of locations during its travel. Serial printers, in general, either print one complete character at a time for each actuation of the print element, or they may print by composing a character by means of the actuation of a plurality of wires or other print elements printing less than an entire character, so that the characters are compositions of bars, dots, etc.

2. Description of the Prior Art

Most of the serial printers print a line of characters by beginning from a left margin and sequentially printing until the line is complete. The sheet on which the printing is being accomplished is then indexed, and the printing element is then returned to the left margin before the subsequent line is printed on the sheet. This mode of operation is relatively inefficient due to the time that is required to return the print element to the left margin, substantially reducing the speed of the printer. Therefore, the speed of printing by a serial printer can be substantially increased by indexing the sheet when a line of print is completed and then printing the next line backwards instead of returning the print element to the left margin.

Such bidirectional printing in serial printers has been practiced prior hereto. Early embodiments of bidirectional printers require that the print head proceed from a preset left margin electric switch to preset right margin electric switch before reversing and printing backwards from right to left. Later improvements provided the programmer of the data processing equipment associated with the serial printer the ability to specify a maximum line length for each program. With this arrangement, the serial print head had only to proceed from the left margin switch to the maximum right position specified by the program before reversing itself for printing from right to left. For programs requiring only short line lengths, which all start at the left margin, this technique significantly increased printer throughput.

In order to further increase printing speed, it is known in such bidirectional printers to store information relative to the right and left margins of the next line to be printed. At the completion of a line of printing, a comparison is made between the end position of the line being printed and the right and left margins of the next line to be printed. On the basis of this comparison, the print head is directed to proceed to the nearer margin position for printing the next line.

Prior Art

The prior art consists of conventional look-ahead techniques for use in serial printers. These U.S. Pat. Nos., such as 3,764,994, 3,970,183, 4,114,750 and 4,179,223, stop the print head at the end of the printing line and determine the closest margin and thereafter move the print head towards that margin.

SUMMARY OF THE INVENTION

This technique does improve printing speed, but there are other considerations involved which may make it desirable to modify this approach. One such consideration is the mechanical wear imposed on the print head mechanism when it is stopped at the end of printing one line, moved to the proper margin for the next line and then moved again to begin printing that next line. This mechanical wear is particularly a concern when the movements of the print head are relatively short and occur in a short period of time.

In accordance with the present invention, the conventional look-ahead technique for bidirectional serial printers is modified by comparing the number of character or print positions between the end of printing on the current line and the margin position for the beginning of printing on the next line, in the direction of print head travel. If this comparison, which is made as the print head approaches the end of the present line, indicates that this number of characters is less than a specified number, print head motion is continued in the same direction past the end of printing on the present line and out to the margin position for the next line. After advance of the paper, printing may then begin, with the print head located at the proper margin position.

DESCRIPTION OF THE PREFERRED EMBODIMENT

Figure 1:
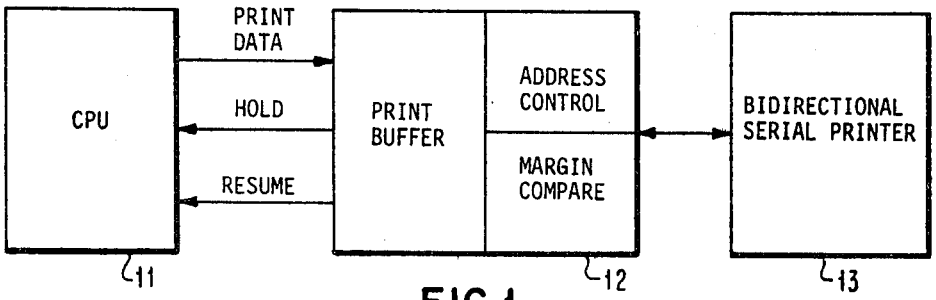
FIG. 1 shows a typical data processing system using the present invention.

FIG. 1 illustrates a data processing system in which the present invention may be employed. The system may include a central processing unit (CPU) 11 which supplies the data to be printed to a bidirectional serial printer 13. A control unit/buffer 12 is connected between CPU 11 and printer 13 for controlling the printer operation. Device 12 includes a buffer portion which is loaded from CPU 11 with data to be printed and which is unloaded by supplying the data to be printed to printer 13. Since CPU 11 will normally operate at a much faster rate than printer 13, the buffer portion of device 12 may be quickly loaded to just short of capacity by CPU 11 and this buffered data supplied to printer 13 at its input rate. A "Hold" line from the buffer portion of CPU 11 signals the CPU that the buffer is at its capacity. With the "Hold" line raised, CPU 11 discontinues sending print data, and does not recommence transmitting print data until the buffer drops the "Hold" line and raises its "Resume" line.

In operation, the buffer portion of device 12 can supply print data to printer 13 whenever the buffer has received at least one line of data to be printed. As each print character is supplied to the printer from the buffer, the buffer space occupied by that character may be filled with a new print character. Preferably, however, an entire print line is retained in the buffer until the line has been printed. This permits the stored print line to be repeated in the event of an error condition in the printing.

Figure 2:
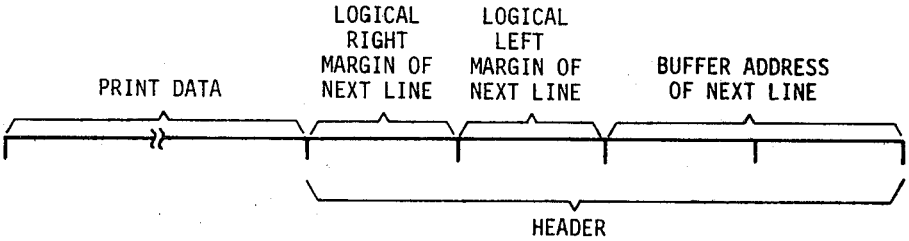
FIG. 2 is a diagram showing the use of next line margin information for producing the comparison of the number of character positions to the next line margin in the direction of print head travel.

Each line of print data includes a header section having at least four bytes of information. This is shown in FIG. 2 where the first two bytes of this header contain information as to the address within the buffer of the next line to be printed. This permits device 12 to locate the next line in the buffer after printing the present line. The next two bytes in the header are used in the present invention to perform the limited look-ahead operation described above. These two bytes identify the logical left and right margins respectively of the next line to be printed. Logical margin means the position at which printing is actually to begin, disregarding blank spaces and the like.

The information in these two margin bytes is decoded and compared with the position of the print head when it reaches the end of its present print line. The end of the present print line is compared with that logical margin of the next line which is in the direction that the print head is moving in printing the present line. Thus, if the print head is moving from left to right in printing the present line, its position at the end of printing the present line is compared with the value of the logical right margin of the next line.

Figure 3:
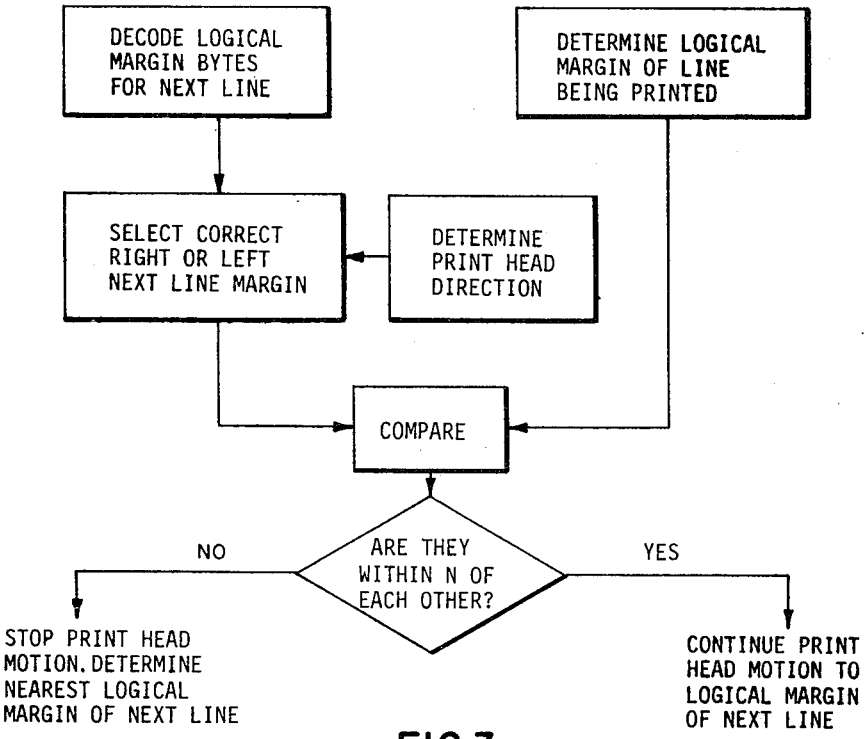
FIG. 3 is a flow chart illustrating the operations performed in carrying out the present invention.

This comparison is done before the print head reaches the end of the present line, and if this comparison indicates that the end of the next line is within a specified number of characters, such as ten characters, of the end of the present line, the print head is not stopped at the end of the present line but instead is kept in motion until it reaches the position corresponding to the logical margin for the next line. At this point, the print head is stopped and, after paper is advanced, it is in position to immediately begin printing the next line. This is indicated in the flow chart of FIG. 3. As mentioned above, the use of the present invention avoids wear problems caused by stopping the print head, moving it a relatively short distance to the margin location for the next line and then starting it moving again to print the next line.

If the comparison above indicates that the logical margin of the next line in the direction of print head travel is located more than the specified number of character positions from the end of the present line, the print head is stopped at the end of the present line and a comparison is made to determine the nearest logical margin of the next line, as in the prior art.

I claim:

1. Print head control means to which a series of character codes are provided manifesting characters to be printed comprising:

buffer means for storing said character codes for a plurality of lines to be printed, the codes for separate lines stored in said buffer means being separated by a header code manifesting at least the left and right margin positions of the next line stored;

moving print head means for printing characters manifested by said character codes; and processor means for controlling said print head movement, said processor means being operative during printing of a given line of characters for comparing the margin position of said next line in the direction of print head movement with the margin position of said given line, said processor means being operative to continue movement of said print head in the present direction of movement if said margin in the direction of print head movement of said next line is within a given number of character spaces of said margin of said given line.

2. Apparatus in accordance with claim 1, in which said processor means is operative, in the event said comparison indicates that the margin position of said next line is not within said given number of spaces, to stop said print head.

3. Apparatus in accordance with claim 2, including means for determining the nearest margin for said next line after stopping said print head.

4. Apparatus in accordance with claim 3, including means for moving said print head to said determined nearest margin for said next line for resumption of printing.

5. Apparatus in accordance with claim 1, in which said given number of character spaces is ten character spaces.

* * * * *